US005223812A

United States Patent [19]

Kreuter

[11] Patent Number: 5,223,812

[45] Date of Patent: Jun. 29, 1993

[54] ADJUSTING DEVICE FOR GAS EXCHANGE VALVES

[75] Inventor: Peter Kreuter, Aachen, Fed. Rep. of Germany

[73] Assignee: Audi AG, Ingolstadt, Fed. Rep. of Germany

[21] Appl. No.: 654,644

[22] PCT Filed: Jul. 28, 1989

[86] PCT No.: PCT/DE89/00493

§ 371 Date: Apr. 22, 1991

§ 102(e) Date: Apr. 22, 1991

[87] PCT Pub. No.: WO90/01616

PCT Pub. Date: Feb. 22, 1990

[30] Foreign Application Priority Data

Aug. 9, 1988 [DE] Fed. Rep. of Germany ..... 3826974

[51] Int. Cl.[5] ..... H01F 3/00

[52] U.S. Cl. ..... 335/256; 335/266; 335/268; 251/129.1

[58] Field of Search ..... 335/256, 266, 268; 251/54, 129.1, 129.16

[56] References Cited

U.S. PATENT DOCUMENTS 4,455,543 6/1984 Pischinger et al. .

4,715,331 12/1987 Kreuter ..... 251/129.1

FOREIGN PATENT DOCUMENTS 3024109 6/1980 Fed. Rep. of Germany .

2137420 10/1984 United Kingdom .

*Primary Examiner*—Lincoln Donovan

*Attorney, Agent, or Firm*—Jacques M. Dulin; Thomas C. Feix

[57] ABSTRACT

An method and apparatus for damping the impact and noise of the anchor plate against the pole surfaces of the electromagnets in a electromagnetically-actuated, spring biased adjusting device for gas exchange valves wherein the actuator assembly is provided with a perimeter casing member which forms an air tight enclosed gap area between the pole surfaces of the electromagnets. The anchor plate is provided with a sealing member along its perimeter edge such that a fluid cushion is formed as the anchor plate approaches a pole surface of either electromagnet. The inner wall surface of the perimeter casing is provided with overflow openings about its middle region to permit communication of fluid from the chambers in the gap on either side of the anchor plate during its mid-point of travel to reduce resistance to anchor plate movement over a majority of its operating range. One or more transverse throttle holes may be provided in the anchor plate to further control air exchange within the enclosed gap area prior to anchor plate impact.

7 Claims, 1 Drawing Sheet

ADJUSTING DEVICE FOR GAS EXCHANGE VALVES

FIELD

The invention relates generally to an improved electromagnetically operated adjusting device for spring-loaded reciprocating actuators in displacement engines, such as for lifting gas exchange valves of internal combustion engines. More particularly, the invention relates to improvements in reducing or dampening the impact noise associated with the striking of a reciprocating anchor plate of the valve stem against the pole surface of each electromagnet as the anchor plate moves from a first operating condition to a second operating condition corresponding to the open and closed positions of the gas exchange valve.

BACKGROUND

An example of an electromagnetically operated adjusting device for gas exchange valves of this type is shown in DE 30 24 109.

This known device discloses a gas exchange valve for an internal combustion engine, the stem of which is joined to the valve disk and has an anchor plate (or armature) which is alternatingly attracted to the pole surface of two opposing electromagnets upon the energizing the solenoid associated with each electromagnet. The engagement of the anchor plate to a pole surface results in either the closed or open position of the valve. As current flow is cut off to the contacting electromagnet the spring system forces the anchor plate in the direction away from the contacted pole surface where it is then attracted to the opposing pole surface by energization of the solenoid associated with the opposing electromagnet. A disadvantage associated with adjusting devices of this type is the noticeable impact noise of the anchor plate as it contacts each pole surface.

DE 30 24 109 teaches to dampen the impact of the moving anchor plate against the pole surface of an excited electromagnet by providing a biasing member, such as coil spring, to decelerate the anchor plate after it reaches its midpoint of travel prior to impacting the affected pole surface. This method necessitates sturdy coil springs to provide sufficient damping and this means that larger electromagnets are necessary to provide sufficient retention forces for holding the anchor plate at the open and closed positions. Thus, adequate damping results in undesirable increases in the size and weight of the actuator assembly GB-A 2 137 420 discloses a similar design for an electromagnetically-operated, spring-biased adjusting device wherein damping of the anchor plate impact is achieved by providing a skirt-like sealing member to the pole surface of each electromagnet whereby an enclosed volume of air is formed by the electromagnet pole surface and the skirt-like sealing member just before the anchor plate impacts the pole surface. This volume of air cushions the impact as it becomes compressed and impact noise is reduced. However, since only the last portion of anchor plate travel is controlled by this sealing affect, the ability to adequately control the impact damping of a fast approaching anchor plate is limited by the cushioning effect attributed to this small volume which is sealed only just prior to impact.

Thus, there is a definite need in the art for an improved solenoid actuated, spring-biased, adjusting device for gas exchange valves which has improved means for significantly damping the impact noise associated with the anchor plate and which also allows for fast switching time behavior.

THE INVENTION

Objects

It is among the objects of the invention to provide an improved solenoid actuated gas exchange valve device having the properties of reduced impact noise associated with the anchor plate as it engages the pole surface of each electromagnet;

It is another object of the invention to provide an improved actuator assembly wherein the gap between the opposing electromagnets is sealed by a perimeter casing thus forming a cylinder for the reciprocating anchor plate, and the anchor plate is provided with a sealing ring which in effect divides the enclosed solenoid gap into two sealed chambers so that a compressible volume of fluid adjacent each pole surface is provided to reduce impact noise;

It is another object of the invention to provide an improved actuator assembly whereby throttle holes are provided adjacent the mid-point region of the perimeter casing to regulate the fluid flow between both chambers as the anchor plate compresses the air volume therein prior to engaging the affected pole surface so that fast switching time behavior is retained;

Still other objects will be evident from the following specification, drawings and claims.

DRAWINGS

SUMMARY

Figure 1:
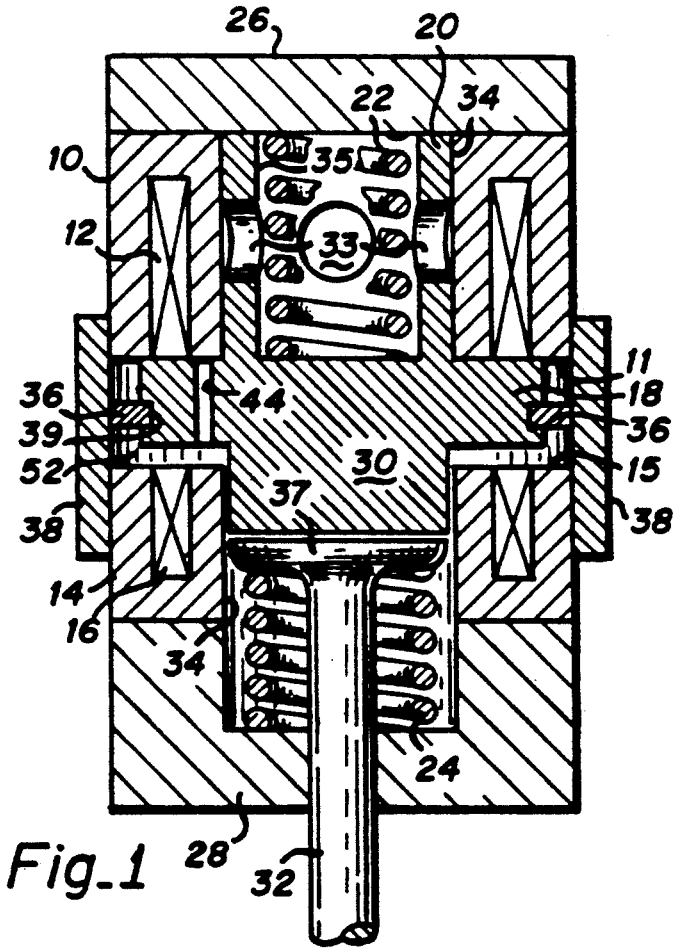
FIG. 1 shows a side elevation, cross-section view of the improved actuator adjusting device of this invention.

I have found that the noise associated with the impact of an anchor plate (or armature) against a pole surface of a magnet in conventional solenoid-actuated positioning devices for gas exchange valves can be significantly reduced or dampened by causing a cushion of air to form between the anchor plate and the affected pole surface just prior to impact. To accomplish this, an airtight casing member is provided which seals the entire gap defined as the space between the pole surfaces of the opposed electromagnets wherein the anchor plate associated with the tappet of a gas exchange valve is cause to alternatingly reciprocate between contact with each pole surface. The enclosure area is sealed from the outside ambient. The anchor plate (or armature) is also provided with a sealing member (such as a ring or gasket) at its perimeter edge which contacts the inner wall of the perimeter casing in a manner such that the anchor plate divides the enclosure or gap area into two sealed chambers whereby each chamber undergoes compression during the approach of the anchor plate towards its adjacent pole surface. This in turn causes a cushion of fluid to form within that compressed chamber to soften or dampen the anchor plate impact against that pole surface.

In order to ensure fast switching time behavior of the anchor plate between each pole surface, it is desirable to minimize drag or resistance due to the compression and vacuum effects associated with each chamber in response to the anchor plate movement. Therefore overflow openings are provided in the middle region of the enclosed area along the inner perimeter wall of the casing such that fluid may be communicated from one chamber to the other chamber when the sealing member of the anchor plate passes by the overflow holes. The overflow holes are sufficiently large such that the sealing member of the anchor plate permits fluid exchange between chambers over 80–90% of the center portion of the anchor plate travel between the opposing pole surfaces.

The impact force of the anchor plate may be further controlled by the use of one or more transverse throttle holes provided in the anchor plate which permit the exchange of fluid from a chamber area undergoing compression (i.e., the chamber area adjacent the pole surface about to be impacted) to the other chamber area. The overflow holes, in combination with the throttle holes, provide the desired control of the anchor plate over the entire operating range of the anchor plate such that fast switching time behavior is retained and the impact noise is significantly reduced.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

FIG. 1 illustrates an isolated view of an adjusting device for a gas exchange valve of the type normally found within the engine block of an internal combustion engine. The adjusting device comprises opposing shielded electromagnets (iron cores) 10 and 14. Each electromagnet is generally U shaped in cross-section to form a cup magnet and has coils or solenoids 12 and 16 annularly installed therein. The solenoids 12 and 16 are aligned parallel to the axis of the annulus coinciding with the axis of the valve stem 32. Each electromagnet also has associated therewith a pole surface. Pole surface 11 is associated with electromagnet 10 and pole surface 15 is associated with electromagnet 14.

In the preferred embodiment both iron cores or electromagnets 10 and 14 are cylindrical in shape and share a common axial bore 34 which is aligned with the vertical axis of the actuator assembly. An anchor plate 18, being reciprocable in the vertical direction (as seen in FIG. 1) is provided and moves back and forth between pole surfaces 11 and 15 during operation. The anchor plate 18 is further provided with an integrally attached upper stem 20 which is disposed to reciprocate within the bore 34 associated with upper electromagnet 10. The anchor plate also includes a lower stem 30 which is disposed to reciprocate within the bore 34 associated with electromagnet 14 and presses against a stamp member or tappet 32 which forms the shaft of a gas exchange valve (valve disc not illustrated).

A spring system is used to accelerate the anchor plate 18 from the contact with a first pole surface of a de-energized electromagnet to the opposing pole surface of an excited electromagnet. The spring system comprises a first upper coil spring 22 and a second lower coil spring 24. Upper spring 22, being receivingly engaged within a central bore 35 of upper stem 20 is stressed to move the anchor plate 18 in a direction away from contact with pole surface 11. Magnet cover 26 serves as a top abutment for spring 22.

In the preferred mode of the invention, upper stem 20 is in the form of a thin walled casing and may have one or more drilled holes 33 along its side wall to achieve a mass reduction. As is seen in FIG. 1, the anchor plate 18 is being held at pole surface 11 and spring 20 is in its compressed state. This is accomplished by the retention or holding forces associated with energized electromagnet 10. This operating condition of the adjusting device corresponds to the closed position of the gas exchange valve.

Spring 24 functions much like a conventional valve spring for cam operated valves in internal combustion engines as it is normally stressed to move the gas exchange valve to the closed position. As is seen in FIG. 1, spring 24 is braced against abutment 28 at its lower end and the stamp portion or tappet 37 of the valve stem 32 at its upper end. The dead point or equilibrium state of the spring system occurs when the solenoids are not activated and is in the middle between the opposing pole surfaces 11 and 15. In other words the dead point of the spring system corresponds to the middle position of anchor plate 18 travel between the opposing pole surfaces 11 and 15.

A cylindrical casing 38 is provided to seal off the air gap between the opposing electromagnets. The casing 38, magnet cover 26, and abutment 28 serve to affix the electromagnets 10 and 14 within the cylinder head (not shown).

Figure 2:
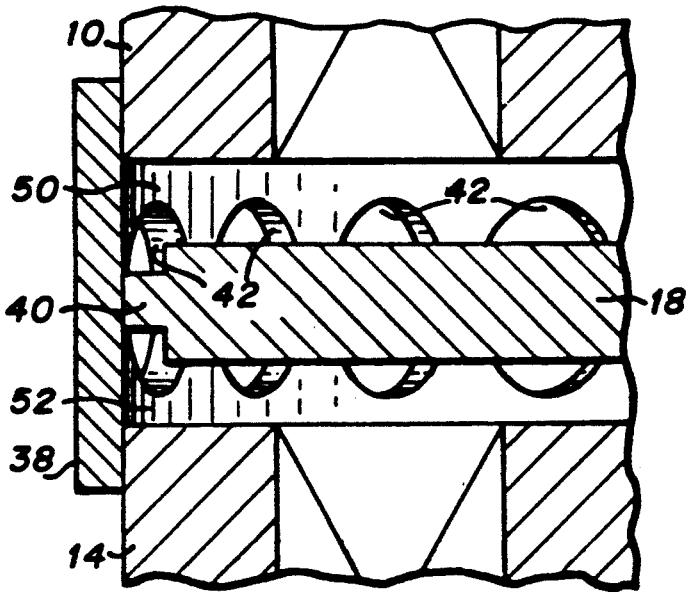
FIG. 2 shows a enlarged fragmentary, cross-sectional view of a second, alternate embodiment for the improved adjusting device of this invention.

Referring to FIGS. 1 and 2, the anchor plate 18 divides the enclosed gap area between the electromagnets into two chambers, namely upper chamber 50 and lower chamber 52. Fluid may be introduced into the chambers 50 and 52 thus providing a damping effect for the anchor plate 18 as it approaches a pole surface of either electromagnet due to fluid compression in the decreasing volume of the effected chamber. Chambers 50 and 52 may communicate with each other by means of one or more control orifices 44 that are selectively placed along the anchor plate 18. The tolerance gaps between the outer diameters of upper and lower stems 20 and 30 and their surrounding iron cores or electromagnets 10 and 14 are sufficient to ensure that no appreciable amount of fluid is permitted to escape from the upper and lower chambers into these tolerance gap regions. In other words, these tolerance gap areas are substantially air tight.

As is seen in FIG. 1, the perimeter edge of the anchor plate 18 is provided with a sealing member 36 which forms a perimeter seal with casing 38 and thus inhibits the flow of fluid around the perimeter edge of the anchor plate from one chamber to another. The sealing member 36 may be in the form of a sealing ring or gasket which is set in a notched grove 39 in the perimeter surface of the anchor plate 18.

FIG. 2 shows an alternate embodiment of the anchor plate 18 which is also adapted to form a perimeter seal with the casing 38 wherein a nub 40 is formed on the perimeter edge of the anchor plate 18 and extends radially to sliding contact the inside perimeter wall of casing 38.

One or more throttle holes 44 (see FIG. 1) may be provided in the anchor plate 18 to permit the additional exchange of fluid between upper and lower chambers 50 and 52. If the fluid to be used is a compressible fluid such as air, the throttle holes serve the additional purpose of reducing vacuum effects. If the fluid to be used is non-compressible, the throttle holes serve as a control orifice for the exchange of the fluid between both chambers.

In the preferred embodiment the fluid to be used is air, but it is understood that oil damping may also be preferable possible since oil damping also permits lubrication of the moving parts of the actuator assembly. When using an oil mist for lubrication, the medium in the chambers would be composed of air and oil.

As is best seen in FIG. 2, a plurality of overflow openings 42 are provided along the inner perimeter wall of casing 38. These overflow openings 42 allow additional fluid exchange between the chambers 50 and 52 as the anchor plate 18 reciprocates past them. The overflow openings 42 are, in actuality, relieved portions (recesses) along the middle area of the inner perimeter wall of casing 38 and thus the holes are sealed to the outside, that is, the overflow openings 42 do not extend clear through the wall thickness of casing 38. The overflow openings 42 thus permit an additional exchange of fluid between the upper and lower chambers 50 and 52 over the middle portion of the anchor plate travel as the anchor plate moves from contact with one pole surface to the other. This, in effect, reduces the resistance to the anchor plate travel over this middle traveling region. Over the last part of the anchor plate travel just prior to impact, the fluid contained within the chamber adjacent the impacted pole surface undergoes a rapid compression since the additional flow of fluid between the chambers through overflow openings 42 is cut off by the sealing member 36 (FIG. 1) or sealing edge 40 (FIG. 2) as it passes by the extreme (upper or lower) edge of the overflow openings 42.

In operation, the anchor plate 18 is moved back and forth by the alternating excitement of solenoids 12 and 16 in combination with the acceleration forces of springs 22 and 24. In each operating condition the anchor plate 18 is held to the pole surface 11 or 15 of an electromagnet 10 or 14 by a retention force generated by excitation of the associated solenoid 12 or 16. The springs are used to accelerate the anchor plate in a direction towards the opposing pole surface upon deactivation of current flow through the contacting electromagnet. The resistance to the motion of the anchor plate due to fluid compression in the chamber areas 50 and 52 is small over a large part of the path of anchor plate travel since the overflow openings 42 provide a rapid exchange of fluid over this portion of travel. After about 80–90% of the total travel path has been covered by the anchor plate 18, the sealing edge 36 (FIG. 1) or 40 (FIG. 2) passes the extreme perimeter edge of the overflow openings 42 thus preventing any further fluid flow around the perimeter edge of the anchor plate 18. A small amount of fluid exchange may still be permitted by the optional provision of the throttle holes 44. The throttle holes 44 permit the fine tuning of the chamber compression rate. Thus, as the anchor plate 18 approaches a pole surface, a fluid cushion is formed which greatly dampens the impact and contributes to noise reduction.

The invention thus achieves the desired dampening effects by selectively controlling a large volume of fluid exchange from the upper chamber 50 to the lower chamber 52 so that a sufficient cushion of fluid is compressed prior to impact through the combined use of overflow openings 42 and throttle holes 44. Provision for rapid fluid exchange over the major portion of anchor plate travel insures that fast switching time behavior of the actuator assembly is retained as the resistive affects of compression and vacuum as produced by the moving anchor plate is minimized.

It should be understood that the anchor plate 18 may be designed without throttle holes 44 without any decrease in performance. However, constant compression of the fluid in the system may have a tendency to create leaks in the sealing member 36 or sealing edge 40 over time, and may even cause fluid to escape through the tolerance gaps between upper stem 20 and the interior perimeter of electromagnet 10 and lower stem 30 and the interior perimeter of electromagnet 14. Provision of throttle holes 44 reduces the tendency for such compression leaks as they provide controlled flow of compressed air between the two chambers 50 and 52.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

I claim:

1. An improved electromagnetically operated, spring-biased actuator assembly for gas exchange valves in internal combustion engines comprising in operative combination:

a) a first actuating solenoid and a second actuating solenoid, said second actuating solenoid disposed spaced apart from said first actuating solenoid to define a gap therebetween;

b) means for reciprocatingly actuating a gas exchange valve, said gas exchange valve being movable between a first, closed operating position to a second, open operating position;

c) said reciprocating actuator means including a generally disc-shaped anchor plate having a central axis and a peripheral edge spaced radially outwardly from said axis, said anchor plate disposed in said gap to travel between said actuating solenoids and selectively attractable to and guidingly reciprocated between positions of engagement with a pole surface of each of said actuating solenoids, said first actuating solenoid pole surface engagement position corresponding to said closed operating position of said gas exchange valve and said second actuating solenoid pole surface engagement position corresponding to said open operating position of said gas exchange valve;

d) a perimeter casing sleeve member disposed surrounding said anchor plate peripheral edge and bridging said gap, said perimeter casing having a wall with an axial length dimension sufficient to span said gap and sealingly engage at least a portion of each of said actuating solenoids to form an enclosure about said gap;

e) said anchor plate including means for dampening the impact of said anchor plate as it engages the pole surface of each of said actuating solenoids to reduce impact noise associated with said anchor plate impact;

f) said dampening means includes a sleeve casing sealing member disposed adjacent to and in association with said perimeter edge of said anchor plate;

g) said sealing member having a perimeter edge which slidingly contacts an inner surface of said perimeter casing sleeve wall to divide said gap enclosure into a pair of sealed chambers when said anchor plate moves between engagement with each of said pole surfaces, said chambers including:

i) a first sealed chamber disposed adjacent said pole surface of said first actuating solenoid;

ii) a second sealed chamber disposed adjacent said pole surface of said second actuating solenoid; and h) said sealing member is adapted to maintain a substantially airtight seal between said perimeter edge of said anchor plate and said inner wall surface of said perimeter casing sleeve so that a cushion of compressible fluid forms adjacent the pole surface of an excited actuating solenoid to reduce impact noise as said anchor plate approaches said excited actuating solenoid.

2. An improved electromagnetically operated, spring-biased actuator assembly as in claim 1 wherein said anchor plate includes means for permitting controlled exchange of fluid between said first and second sealed chambers.

3. An improved electromagnetically operated, spring-biased actuator assembly as in claim 2 wherein said controlled fluid exchange means is a throttle hole.

4. An improved electromagnetically operated, spring-biased actuator assembly as in claim 1 wherein:

a) said dampening means includes a flange disposed adjacent a perimeter edge of said anchor plate;

b) said flange extends a radial distance sufficient to permit sliding contact with an inner surface of said perimeter casing sleeve wall to divide said enclosure into a pair of sealed chambers when said anchor plate moves between engagement with each of said pole surfaces, said chambers including:

i) a first sealed chamber disposed adjacent said pole surface of said first actuating solenoid;

ii) a second sealed chamber disposed adjacent said pole surface of said second actuating solenoid; and c) said sliding contact between said flange and said inner wall surface having a tolerance sufficient to restrict the exchange of fluid between said first and second chambers to form a cushion of compressible fluid forms adjacent the pole surface of an excited actuating solenoid to reduce impact noise as said anchor plate approaches said excited actuating solenoid.

5. An improved electromagnetically operated, spring-biased actuator assembly as in claim 4 wherein:

a) said inner surface of said perimeter casing sleeve wall includes means for controlling the exchange of compressible fluid between said first and second sealed chambers to reduce excess pressure build-up and vacuum effects within each of said chambers and to maintain fast time switching behavior of said anchor plate.

6. An improved electromagnetically operated, spring-biased actuator assembly as in claim 5 wherein:

a) said fluid exchange control means is a plurality of through holes medially disposed in said inner wall surface of said perimeter casing: and b) each of said through holes has a diameter sufficient to permit the controlled leakage of fluid to pass therethrough over a middle range of anchor plate travel between engagement with each of said pole surfaces as said flange of said anchor plate moves by said through holes.

7. An improved electromagnetically operated, spring-biased actuator assembly as in claim 6 wherein:

a) said fluid exchange control means is a plurality of recesses medially disposed in said inner surface of said perimeter casing wall; and b) said recesses provide pathways around said flange for the controlled leakage of fluid between said first and second sealed chambers over a middle portion of said anchor plate travel between engagement with each of said pole surfaces.

* * * * *